US005125720A

United States Patent [19]

Salani

[11] Patent Number: 5,125,720

[45] Date of Patent: Jun. 30, 1992

[54] MOUNTING ARRANGEMENT FOR CUTTER SOCKET

[75] Inventor: C. Ranjan Salani, Springfield, Ohio

[73] Assignee: Koehring Company, Milwaukee, Wis.

[21] Appl. No.: 602,643

[22] Filed: Oct. 24, 1990

[51] Int. Cl.[5] ..... E21C 35/18

[52] U.S. Cl. ..... 299/91; 299/92

[58] Field of Search ..... 299/79, 91, 92, 93; 37/142 A; 175/413

[56] References Cited

U.S. PATENT DOCUMENTS

| | | | |
|---|---|---|---|
| 3,575,467 | 4/1971 | Davis | 299/92 |
| 3,614,164 | 10/1971 | Davis | 299/92 X |
| 4,068,897 | 1/1978 | Amoroso | 175/413 X |
| 4,087,928 | 5/1978 | Mickus | 37/142 A |
| 4,094,611 | 6/1978 | Harper | 299/91 X |
| 4,268,089 | 5/1981 | Spence et al. | 299/91 X |
| 4,275,929 | 6/1981 | Krekeler | 299/91 |
| 4,316,636 | 2/1982 | Taylor et al. | 299/92 |
| 4,349,232 | 9/1982 | Braun et al. | 299/92 |
| 4,536,037 | 8/1985 | Rink | 299/92 |
| 4,621,871 | 11/1986 | Salani | 299/91 |

FOREIGN PATENT DOCUMENTS

| | | | |
|---|---|---|---|
| 2855577 | 7/1980 | Fed. Rep. of Germany | 299/93 |
| 1121008 | 1/1966 | United Kingdom | 299/91 |
| 1096146 | 12/1967 | United Kingdom | 299/92 |

*Primary Examiner*—David J. Bagnell

*Attorney, Agent, or Firm*—Lane, Aitken & McCann

[57] ABSTRACT

A socket for holding a cutting bit is removably attached by one or more resilient pins to a base permanently secured to a rotor. The pins are inserted through partially aligned openings in the socket and base and are radially expandable to bias load bearing surfaces on the socket into firm engagement with load bearing surfaces on the base. The pins themselves bear a portion of the cutting forces, the pins being selected to fail in shear when extraordinary forces are encountered in order to prevent damage to the bases and the welds securing the bases to the rotor.

11 Claims, 5 Drawing Sheets

MOUNTING ARRANGEMENT FOR CUTTER SOCKET

The present invention relates to machines for cutting hard abrasive materials such as road surfaces and, more particularly, to an improved arrangement for attaching cutting bits to such machines.

BACKGROUND OF THE INVENTION

Machines such as road cutting recycler/reclaimers or planers, mining cutters, stabilizers, pulverizers, recyclers and other rotary cutters employ cutting bits mounted on a rotor which is rotated while the bits engage a material to be cut. The machines described, particularly those used for cutting hard materials such as asphalt, concrete, minerals and rock, are engineered to withstand the severe forces and abrasion inherent in engaging the material being cut. For example, in a road planer designed to remove an upper layer of asphalt or other road paving material from a road surface, a rotor supporting cutting bits is rotated by an engine and lowered to engage the road surface. Due to high abrasion, the cutting bits, bit holders and attachment parts on the rotor are worn or damaged, and thereby often fail, necessitating the replacement of the parts.

In some cutting machines in the prior art, the bit holders, also known as sockets, that hold the cutting bits are permanently affixed to a rotor, such as a drum or disk, by welding. In other cutting machines, the sockets are welded to blocks or spacers which are in turn welded to the rotor. Replacement of such sockets requires cutting off the old socket, grinding and cleaning the surface of the rotor, blocks or spacers, and accurately positioning the new socket and welding it in place. Such an operation is not only very time consuming, but occasionally also requires removal of the rotor assembly from the machine and transportation of the assembly to a shop to perform the work. Thus, the cost of replacement of the cutting bits is very expensive, and the downtime of the machine and resultant work delays are also very costly.

In some cases, the sockets are attached to bases which are bolted to the rotor. Attachment of the bases with conventional bolts presents various problems. For instance, the nut holding the bolt often will freeze on the bolt due to rust, or the bolt head will wear out or become stripped or sheared off. The bolts are subjected to heat caused by friction and stress, causing some bolts to bend or break. Removing a damaged bolt can be a tedious and time consuming procedure which often requires cutting the bolt with a welding torch. Because of the difficulties associated with the removal of the damaged parts of such bit attaching assemblies, the parts are often left on the rotor, where they can cause additional damage. Bolt-on and other replaceable sockets, or holders, are available, but most of them are very expensive, and their usage may not be justified due to high cost. Also, such designs still require an enormous amount of time to change the damaged sockets.

Sockets break or wear out frequently, so that repeated removal and replacement are necessary at each socket location on the rotor. The repeated welding necessary at each location crystallizes the material on the rotors, blocks or spacers, and, as a result, subsequent weldings have less and less strength and the welds repeatedly break. Another problem posed by such cutting and welding is that, without great care, the replacement sockets may not be positioned at the original locations and at the original angles. If a base and its corresponding socket are out of alignment on the cutting rotor when it is in use, the associated cutting bit will be subjected to different forces from the other cutting bits, which results in uneven wear among the bit attaching assemblies. A further problem often encountered with replacement bit attaching assemblies is an imprecise fit among the components of the assemblies. If the assemblies of sockets and bases are not solidly secured and tight fitting, the parts tend to break more frequently or wear at an accelerated rate due to the hammering or chattering of component on component.

In some cutting applications, it has been found that different numbers of cutting bits or teeth are desired to achieve greatest efficiency. For example, it may be desirable to remove asphalt from only a portion of a road surface. It is also desirable to be able to easily adjust the depth of the cut. These adjustments are typically achieved by removing a number of the cutting teeth from the rotor or replacing the entire rotor with a new rotor with an arrangement suited for the particular application. However, because of the cost, time and trouble involved in adding or removing the cutting bits or locating a suitable replacement rotor, contractors use an inefficient rotor or cutting bit arrangement for a job.

SUMMARY OF THE INVENTION

By the present invention, a base for each socket is welded to a rotor, and a socket is secured in the base without the use of welding or bolts, so that sockets can easily and quickly be removed and replaced in the field. The sockets are held in tight engagement on their bases, even after the load bearing surfaces of the sockets and bases are worn, and accelerated wear is thereby avoided. In addition, the sockets are mounted on their bases in an arrangement which securely holds the sockets and the cutter bits on the rotor under the normal forces encountered in a cutting operation, but allows the socket to separate from the base when the cutter bits or sockets encounter extraordinarily large forces which would break any of the sockets, or when the sockets are worn out. In one embodiment, a groove in the socket fits over the base, and an inclined face on the socket rests against a mating inclined face on the base. In another embodiment, a single leg on the socket is received in a slot in a U-shaped base. The leg has an inclined surface at one end bearing against a similarly inclined surface on the base and shoulders engaging top surfaces on the base.

A radially expandable spring pin retains the socket on the base by traversing generally aligned openings in overlapping portions of the base and socket. The openings are in partial alignment with each other, being slightly offset but defining a straight passageway. This configuration allows the radially expandable pin to exert forces on the peripheries of the openings to draw the base and socket together. Thus, the pin constantly urges the socket and base together. The pin is designed to bear a part of the shear forces but engineered to fail before the socket or base or its welding on the rotor breaks. The base has an open rear so that there is no impediment preventing the socket from moving to the rear if the pin fails, so that the socket is free to move rearward out of the base. Thus, if a severe force or impact great enough to damage the components is encountered, an inexpensive sacrificial pin will break instead of the base or welds. In one embodiment of the invention, a plurality of sets of partially aligned openings and a plurality of pins are provided to retain each socket on its base.

The assembly configuration according to the invention provides for quick replacement of the parts in the field thus reducing valuable downtime. If a force severe enough to damage an assembly is encountered, the pin fails, allowing the socket to separate from the base. A worker can quickly retrieve the socket or take a new socket, put the components back together, and drive in a new pin, all without disassembly or transportation of the rotor, cutting, grinding, cleaning, or aligning, all without new bits, sockets or bases, and all in the field. If a different configuration of teeth on a cutting rotor is desired, the spring retaining pins can be easily be removed in the field with a hammer to permit removal of sockets from some locations, and the sockets can quickly and precisely be positioned and the pins inserted at other locations. Base protecting caps in place of sockets can be fitted on the bases with the same pins when a tooth configuration calls for the omission of sockets from such bases.

DETAILED DESCRIPTION OF THE PREFERRED EMBODIMENTS

Figure 1:
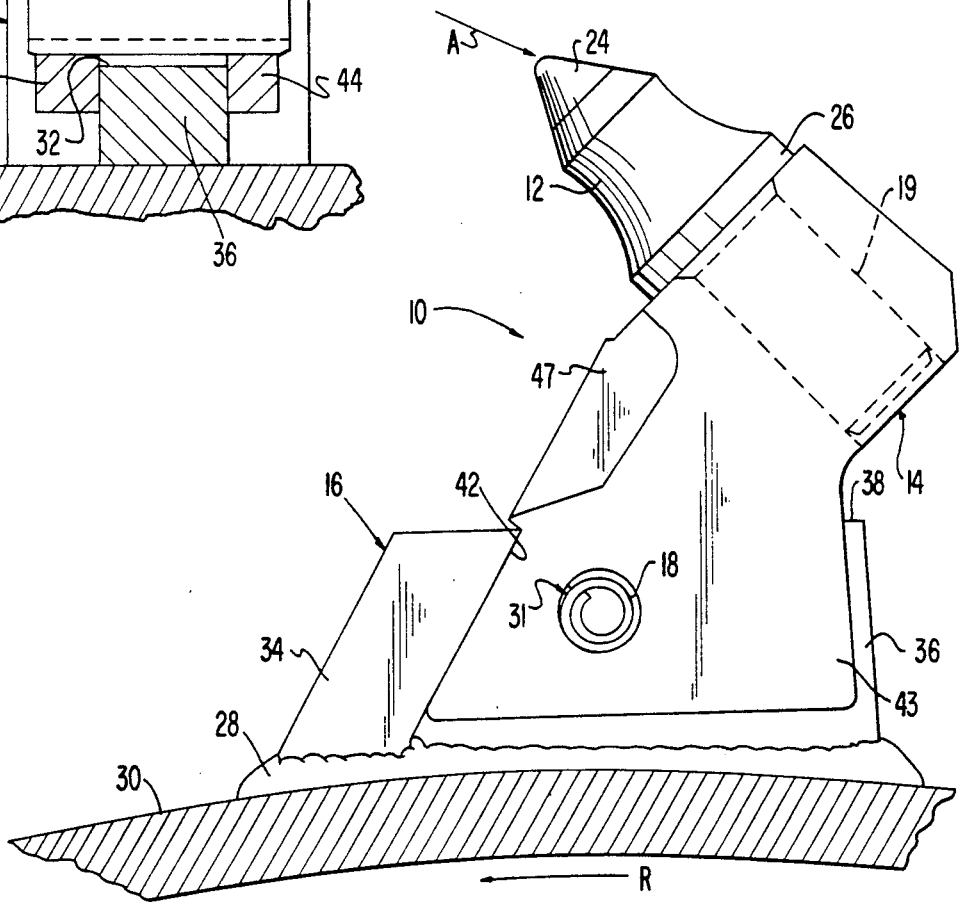
FIG. 1 is a side view in elevation of an assembly of a cutting bit, a socket and a base in accordance with the present invention on a rotor of a cutting machine.

As can be seen from FIG. 1, the reference numeral 10 designates generally a first embodiment of the cutting bit attachment assembly according to the present invention. The assembly includes a cutter or cutting bit 12, a lug or socket 14, a base 16 also known as a block, foot or mounting, and a radially expandable spiral spring retaining pin or roll pin 18. The cutting bit 12 has an elongated shank 19 with a circular cross section that is received by a cylindrical cavity 22 (FIGS. 2 and 5) located in the upper portion of socket 14. The cutting bit 12 has a conical or bullet shaped nose that terminates in a hardened tip 24 which engages the material to be cut and a circular shoulder 26 which engages an upper face of the socket 14 to transmit the cutting forces, indicated by the arrow A, to the socket. In FIG. 1, the socket 14 is shown in assembled position on the base 16, which is fastened, preferably by a weld 28, to a rotor 30, such as a drum. The socket 14 is attached to the base 16 by the radially expandable spiral spring retaining pin 18, which is inserted through generally aligned circular openings 31 and 32 in the socket 14 and the base 16, respectively.

Figure 2:
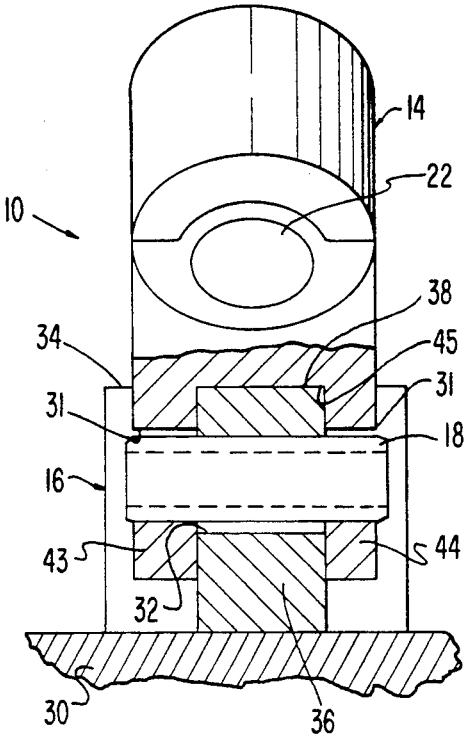
FIG. 2 is a rear view, with parts in section, of the assembly shown in FIG. 1.
Figure 3:
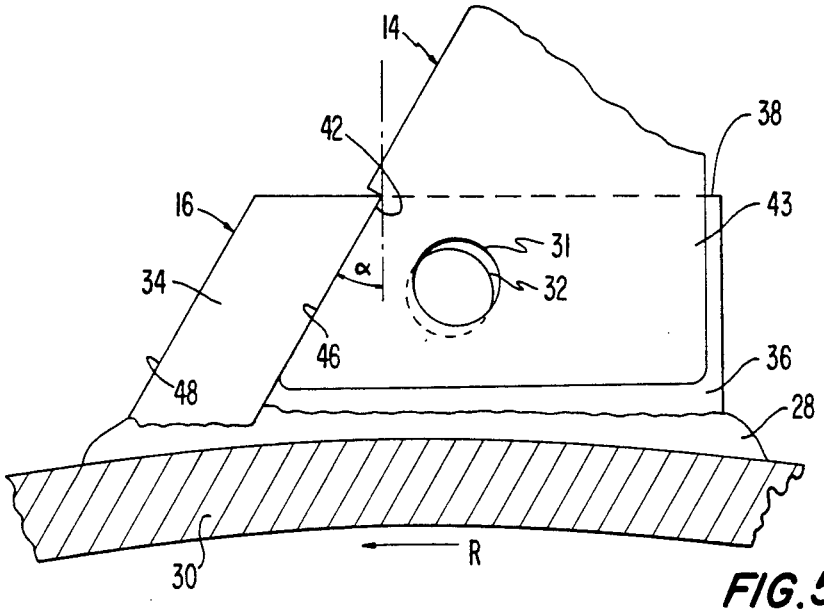
FIG. 3 is a side view of the assembly of FIG. 1 with the socket broken away and the pin removed.

As can be seen from FIGS. 2 and 3, the openings 31 and 32 are in partial registration with one another to define a transverse passageway through the socket 14 and the base 16. A portion of the base !6 projects into an imaginary cylinder defined by the openings 31 in the socket 14 and, at a diametrically opposite location, portions of the socket 14 project into an imaginary cylinder defined by the opening 32 in the base 16, thereby defining a passageway including a restriction having a generally elliptical cross section. The base 16 projects into the imaginary cylinder defined by the openings 31 of the socket 14 at the top and the rear, as shown in FIG. 3. The amount of projection shown in FIG. 3 is greatly exaggerated for clarity of illustration.

Figure 4:
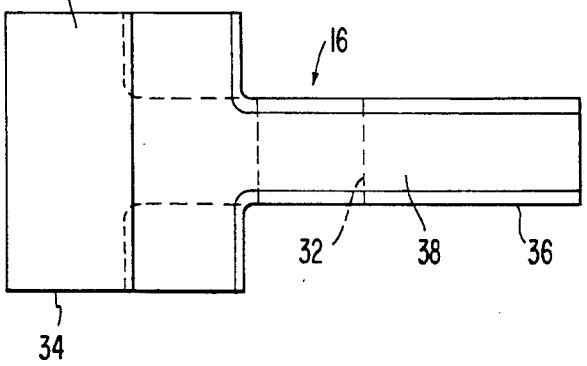
FIG. 4 is a plan view of the base of FIG. 1.

As can be seen from FIG. 4, the base 16 comprises a T-shaped member having a rectangular plate portion 34 oriented transverse to the direction of rotation of the rotor 30 and a longitudinal plate portion 36 parallel to the direction of rotation. The base 16 can be a single cast machine part, or can be made by welding two plates in perpendicular relationship to form the "T"-shaped part. The bottom surface (not shown) of the base 16 is arcuate to conform to the curved surface of rotor 30. The transverse plate portion 34, which defines the cap of the "T", is at the leading end of the base 16, with respect to the direction of rotation of the rotor 30, and lies at an oblique angle, sloping from the rotor 30 upwardly as seen in FIG. 3 and rearwardly relative to the direction of rotation, which is indicated by the arrow R. The longitudinal plate portion 36 has a top surface 38 parallel to a plane lying tangent to the rotor 30 at the line of attachment of the base 16 to the rotor. The transverse plate portion 34 has rear surfaces 42, also sloping upwardly and rearwardly and defining an angle $\alpha$ with a line perpendicular to the top surface 38. The angle is preferably in the range of 15 to 45 degrees, and an angle of 30 degrees has been found to work well.

Figure 5:
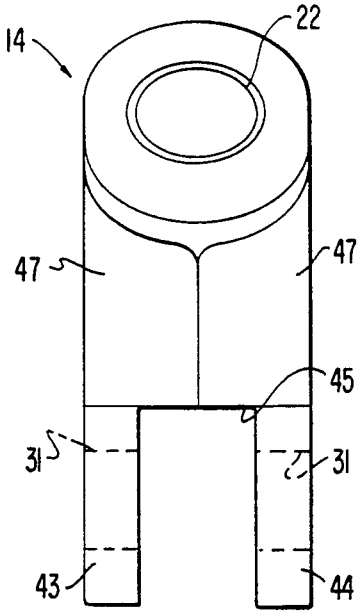
FIG. 5 is a front elevation of the socket of FIG. 1.

As can be seen from FIG. 5, the socket 14 includes a pair of downwardly projecting plate portions to form legs 43 and 44 defining a groove having a bottom surface 45 on the bottom portion of the socket 14. The groove extends longitudinally through the lower portion of socket 14, parallel to the direction of rotation R of the rotor 30 and has open ends. The parallel legs 43 and 44 extend downward and project forward, terminating in forward surfaces 46 lying at an angle such that the forward surfaces 46 are parallel to the rear surfaces 42 on the transverse plate portion 34 of the base 16. The openings 31 are precisely located with respect to the inclined forward surfaces 46 of the legs and the bottom surface 45 of the groove. When the socket 14 is placed on the base 16, the legs 43 and 44 straddle the longitudinal plate portion 36 of the base member 16, and the bottom surface 45 of the longitudinal groove squarely engages the top surface 38 of the longitudinal plate portion 36. These are principal load bearing surfaces The longitudinal groove is sized to fit snugly over the longitudinal plate portion 36. This tight fit helps avoid lateral hammering or chattering between the socket 14 and the base 16.

Since the socket 14 does not need to be welded to anything, its material composition and hardness are selected to give a long wear life. In addition, the forward side of the socket 14 can be defined by laterally inclined surfaces 47 which deflect material to the side and thereby further reduce wear. The front face 48 of the base 16 can be protected with a hard facing or with hard carbide shields (not shown) welded to it.

When the spiral spring retaining pin 18 is inserted through the transverse passageway in the generally aligned openings 31 and 32, it extends from laterally beyond an exterior surface of one of the legs 43 of the socket 14, through the generally aligned openings 31 and 32, to beyond the exterior surface of the other leg 44 of the socket, as can be seen in FIG. 2. An exterior surface of the spiral spring retaining pin 18 engages an arc in the portion of the base 16 defining the opening 32, the arc being centered about a point between the top and the rear of the opening, as can be appreciated from FIGS. 2 and 3. As a result, there is a gap between the spiral spring retaining pin 18 and the legs 43 and 44 generally along the same arc. On the opposite side of the opening 32 of the base 16, the opening 32 projects below and forward of the openings 31 of the socket 14. Accordingly, on this side of the transverse passage, the spiral spring retaining pin 18 engages the legs 43 and 44 of the socket 14, and there is a gap between the pin and the base 16. The offset of the opening 32 of the base 16 relative to the openings 31 of the socket 14 has a downward component and a forward component. Since the pin 18 is made of spring steel and, therefore, inherently expands radially, due to its shape, it exerts forces on all of the surfaces which it engages radially. Since the pin 18 has a perimeter in its relaxed, expanded condition which is larger than the periphery of the constriction in the passageway, it pushes upwardly and rearwardly against the opposing surface of the opening 32 in the base 16, but does not move the base because the base is secured to the rotor 30. The pin 18 also pushes the portions of the legs 43 and 44 around the openings 31 in the socket 14 downward and forward and, since the socket 14 is not fixed, the pin 18 moves the socket 14 into snug engagement with the top surface 38 and the rearwardly facing surfaces 42 of the base 16.

As can be seen from FIGS. 2 and 3, the opening 32 in the base 16 is positioned slightly farther below the top surface 38 of the base than the openings 31 in the socket 14 are spaced below the bottom 45 of the groove, which engages the top surface 38. The opening 32 is also slightly farther forward, with respect to the direction of rotation R of the drum 3, than the openings 31 are, when the inclined forward surfaces 46 of the legs 43 and 44 are in contact with the rearwardly facing surfaces 42 of the base 16. This configuration assures a resilient and tight fit. The circumference of the opening 32 through the base 16 can be slightly larger than that of the openings 31 through the socket 14. This allows looser tolerances on the location of the opening 32 relative to the top surface 38 and the rearwardly facing surfaces 42.

The elasticity of the radially expandable pin 18 causes the pin to try to expand to a diameter greater than the diameter of the openings 31 and 32 through the base 16 and the socket 14, or at least to expand to a diametrical dimension greater than the distance between the portions of base 16 and the socket which the pin 18 engages. As a result, the pin 18 pushes the socket 14 downward so that the bottom 45 of the groove is maintained in snug engagement with the top surface 38 of the base 16 and forward so that the forward surfaces 46 of the legs 43 and 44 are kept in snug engagement with the rear surfaces 42 of the transverse plate portion 34 of the base. Through use of the assembly according to the present invention, when the mating surfaces 45, 38, 42 and 46 wear down over time, no gap between them results because the pin 18 expands farther, again moving the surfaces 45 and 42 into contact with the surfaces 38 and 46, respectively, to compensate for the wear, thereby keeping the surfaces 45 and 46 of the socket 14 in tight engagement with the mating surfaces of the base 16.

The spiral pin 18 is chosen to be the weakest part of the assembly and, in the case of extreme impact, will break before any of the base 16, socket 14, cutting bit 12 or weld 28 break. Thus, in the event of extreme impact, the need for costly repairs and replacement parts is reduced and all that is required is replacement of an inexpensive pin. In the case of normal wear, the pin 18 can be easily knocked out with a hammer and a simple tool and removed, so that a worn out socket 14 can be replaced by a new one or a new configuration of the cutting bits on the rotor 30 can be arranged in the field.

Figure 7:
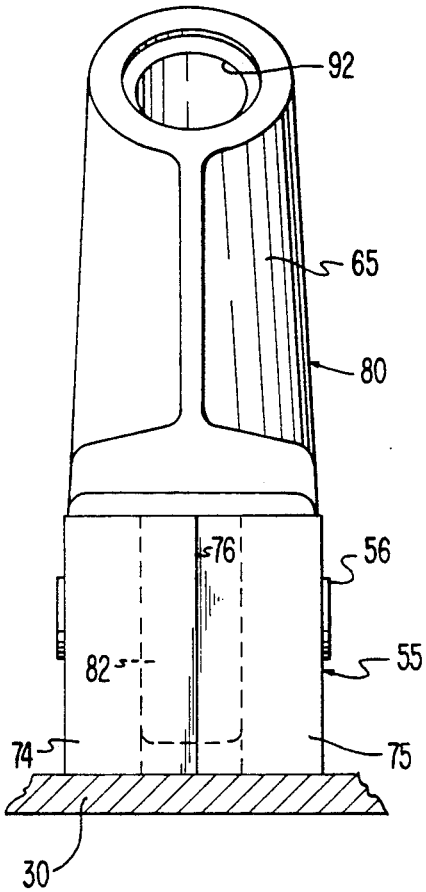
FIG. 7 is a front view in elevation of the assembly of FIG. 6.
Figure 6:
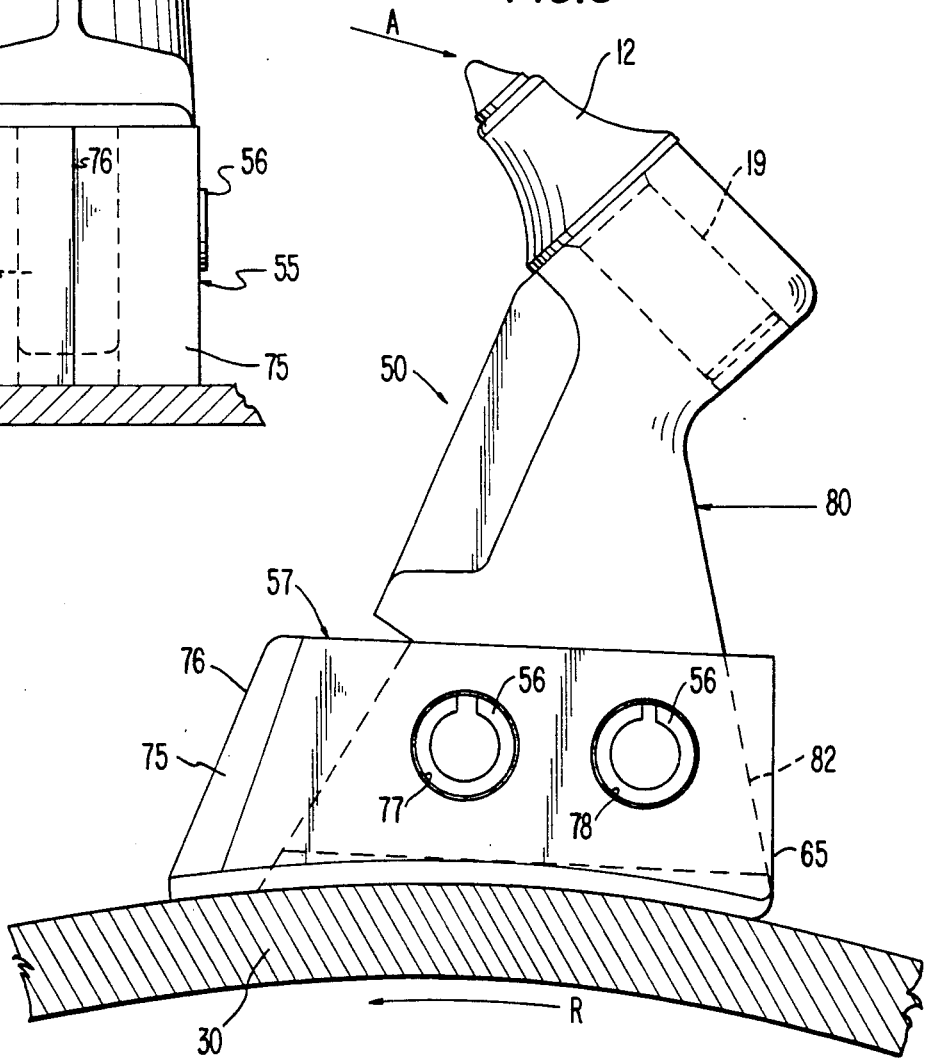
FIG. 6 is a side view in elevation of a second embodiment of the assembly according to the present invention.

FIGS. 6 and 7 show a cutting bit attachment assembly 50 according to a second embodiment of the invention. Like the assembly 10 shown in FIG. 1, the assembly 50 is comprised of a cutting bit 12, a socket, and a base which is permanently fastened to a rotor 30. However, in the second embodiment, two radially expandable spring retaining pins, each inserted through a passageway defined by a set of generally aligned openings, are employed to resiliently connect the socket to the base. Furthermore, the radially expandable spring retaining pins are in the form of roll pins 56.

Like the spiral pin 18 in the first embodiment, roll spring retaining pin 56 is radially expandable, being made of spring steel, but differs from the spiral pin 18 in that it has the shape of an incomplete ring, having a gap between adjacent ends. Although the spiral pin 18 has been illustrated in connection with the embodiment of FIGS. 1–5 and the roll spring retaining pin 56 has been illustrated in connection with the embodiment of FIGS. 6–11, spiral pins 18 can be used with the latter embodiment and roll spring retaining pins 56 can be used in connection with the former embodiment, and even one pin of each type can be used where two transverse passageways through an assembly are employed. Furthermore, two transverse passageways can be used with the embodiment of FIGS. 1–5 and a single passageway can be used in connection with the embodiment of FIGS. 6–12. The roll spring retaining pins 56 provide the same advantages as the spiral pins 18 which were outlined above. Spiral and roll spring retaining pins both expand radially within the confines of the openings and exert pressure on the inner surfaces of the openings. This pressure assists in retaining the pins within the passageways formed by the openings.

Figure 8:
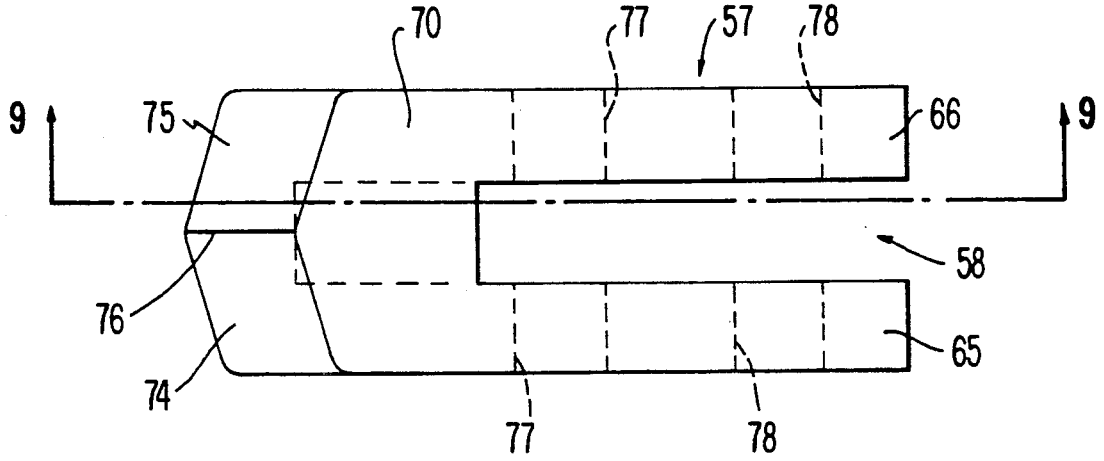
FIG. 8 is a plan view of the base of FIG. 6.
Figure 9:
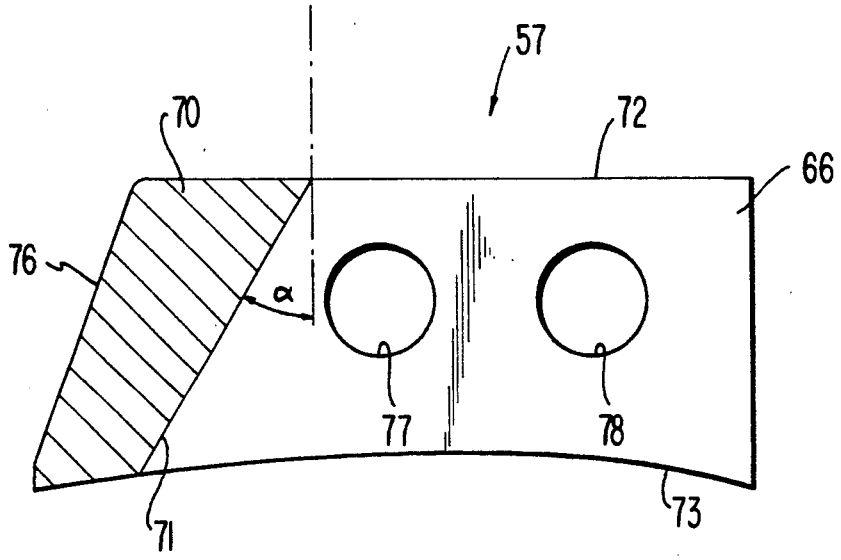
FIG. 9 is a sectional view along line 9—9 of the base depicted in FIG. 8.

As can be seen from FIGS. 8 and 9, the base 57 has a longitudinal slot 58 defined by two parallel legs 65 and 66, and a frontal section 70 which closes the slot 58 at one end. The frontal section 70 includes a rear surface 71 which is inclined upwardly and rearwardly with respect to the direction of rotation R of the rotor 30. The rear surface 71 of the frontal portion 70 has an angle of inclination $\alpha$ with respect to a line perpendicular to the upper surface 72. The angle $\alpha$ is preferably in the range of 15 to 45 degrees, and an angle of 30 degrees has been found to be especially effective. The base 57 has a bottom surface 73 which is curved to conform to the curvature of the rotor 30.

The exterior of frontal section 70 has two beveled faces 74 and 75 that meet at a leading edge 76. The beveled faces 74 and 75 are angled to the side to deflect debris that may contact the base. The beveled faces 74 and 75 mitigate the severity of the forces to which the weld holding the base 57 to the rotor 30 will be subjected. The beveled faces 74 and 75 may be further protected by a hard facing such as carbide shields welded to the faces. A similar carbide shield can be provided on the front surface of the base 16 of the embodiment of FIGS. 1-5. The base 57 is preferably formed by casting, and two sets of aligned openings 77 and 78 are formed to accept spring retaining pins, as is depicted in FIG. 6.

Figure 10:
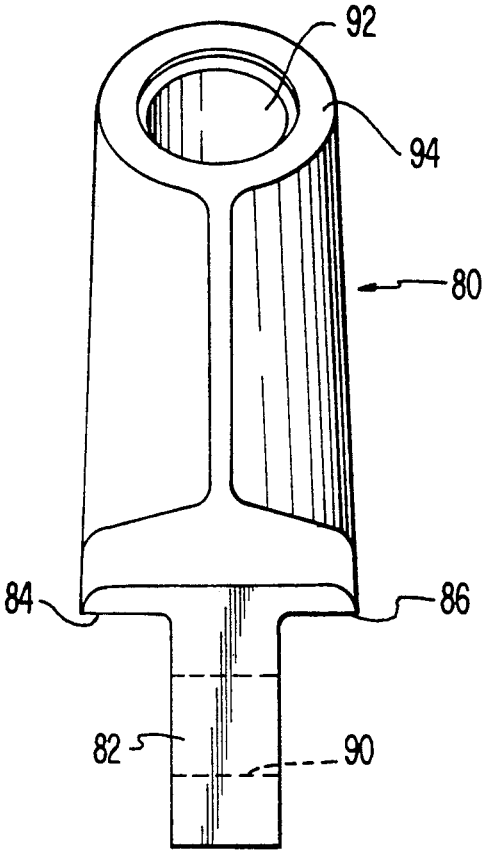
FIG. 10 is a front elevation of the socket of FIG. 6.
Figure 11:
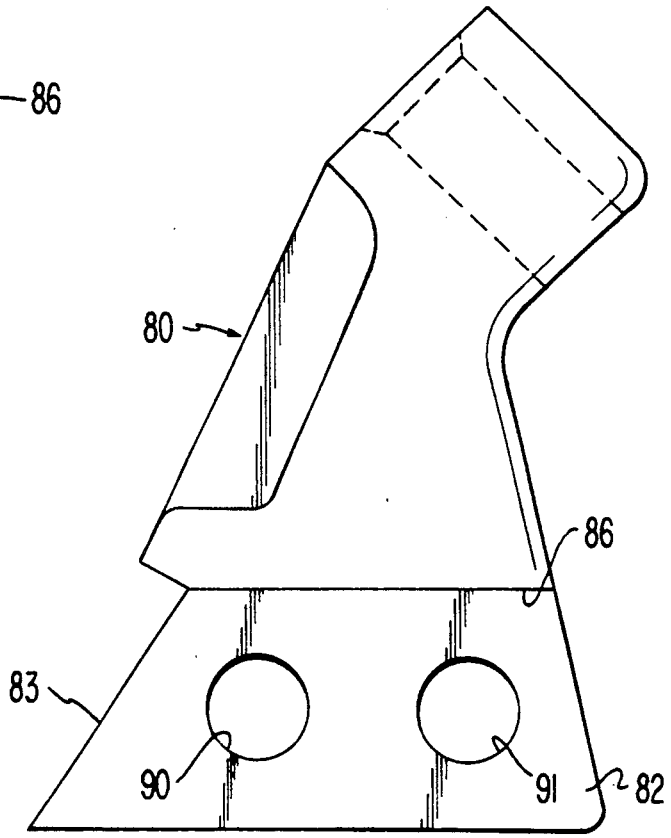
FIG. 11 is a side view in elevation of the socket of FIG. 10.

As can be seen from FIGS. 10 and 11, the socket 80 has a central leg 82 extending downward from the body of the socket. The leg 82 is dimensioned to fit precisely with a snug fit within the slot 58 of the base 57 shown in FIG. 8. The leg 82 has a frontal face 83 which is inclined precisely at the same angle as the rear surface 71 of the frontal section 70 in the base 55. The protrusion of the leg 82 from the socket 80 defines elongate shoulders 84 and 86. When the socket 80 is connected to the base 57, the shoulders 84 and 86 rest on the upper surface 72 of base 57, and the connection resembles a mortise and tenon joint. In this embodiment, the base 57 with its two parallel lateral sides 65 and 66 which define the slot serve as the mortise sections and the leg 82 serves as the tenon that fits within the slot.

Also provided on the lower part of the socket 80 are openings 90 and 91. Like the embodiment depicted in FIGS. 1-5, when the socket 80 is in position on the base 57, the openings in base 57 and socket 80 are not in complete axial alignment. The openings 90 and 91 in the socket are located closer to the shoulders 84 and 86 than the openings 77 and 78 are to the upper surface 72 of base 57. The openings 90 and 91 are also slightly farther rearward, with respect to the direction of rotation R of the rotor 30, than the openings 77 and 78 are, when the frontal face 83 of the leg 82 contacts the rear surface 71 of the frontal portion 70 of the base 57. Thus, the openings 90 and 91 of the socket 80 are offset relative to the openings 77 and 78 of the base 57 such that portions of the legs 65 and 66 of the base project into imaginary cylinders defined by the openings 90 and 91 from above and from the rear. When a spring retaining pin 56 is inserted through the passage defined by each set of aligned openings 77, 90 and 78, 91, this offset arrangement ensures that the socket 80 is biased tight against the upper surface 72 of the base 57 and against the rear surface 71 of the frontal section 70 of the base 57. The use of the roll spring retaining pin 56 tightens the entire assembly, thereby reducing vibration and play between the components. The reduction in vibration and play results in less wear to the components that make up the assembly.

Defined in an upper section of the socket 80 is a bore 92 positioned to accept a variety of cutting bits, so that, when the rotor 30 is turned while engaging a surface, the bit contacts the surface at the optimum cutting angle. As with the first embodiment, cutting forces are transmitted from the cutting bit 12, through the socket 80 to the base 57. These forces have vertical components, which are transmitted through the socket 80 to the top surface 72 of the base 57 via the shoulders 84 and 86. In both the first and second embodiments, the cutting force A produces a moment about the spring retaining pins, thereby pushing the surfaces 46 and 83 of the sockets 14 and 80, respectively, into contact with the surfaces 42 and 71 on the bases 16 and 57. This is true whether a one or two spring retaining pin arrangement is employed. The spring retaining pins bear a portion of the cutting forces. In the event that an extraordinary force is encountered by the bit attachment assembly, the pins 56 will fail before the socket 80 or the base 57 is damaged. When the pins 56 fail, the socket 80 is free to move rearward out of the slot 58.

While specific embodiments of the invention has been shown and described in detail to illustrate the application of the principles of the invention, it will be understood that the invention may be embodied otherwise without departing from the spirit and scope of the invention. For example, features described in connection with the first embodiment can be employed with the second embodiment, and vice versa. In addition, other modifications may be made to the embodiments of the invention disclosed herein without departing from the invention.

I claim:

1. Apparatus for removably mounting a cutter on a support for movement in a predetermined direction to cut a work surface, comprising:
   - a socket for receiving the cutter;
   - a base for receiving the socket;
   - means for securing the base to the movable
   - support, said socket and said base each having at least one load bearing surface for bearing forces imposed on said socket and said base, the load bearing surface of said socket engaging the load bearing surface of said base; and
   - means for biasing the load bearing surface of said socket and said load bearing surface of said base into tight engagement with one another, said biasing means comprising means for preventing the imposition of overloading forces on either of the base and the securing means.

2. Apparatus according to claim 1, wherein said biasing means comprises at least one spring pin.

3. Apparatus according to claim 1, wherein said biasing means comprises:
   - an opening in said socket defining a central axis parallel to said load bearing surface of said socket;
   - an opening in said base defining a central axis parallel to said load bearing surface of said base, said openings being offset from one another but sufficiently in alignment to define a straight passageway through said opening; and
   - a radially expandable pin extending through said straight passageway, said pin having an expanded condition in which said pin has a transverse cross sectional area larger than the transverse area of said straight passageway, whereby said pin biases the portions of said socket and said base which engage said pin away from one another and thereby biases the load bearing surface of said socket and the load bearing surface of said base into tight engagement with one another.

4. Apparatus according to claim 3, wherein the opening in said socket and the opening in said base each define a circle, the load bearing surface on said socket faces generally toward said openings, and the load bearing surface on said base faces generally away from said openings, the circumference of the opening in said socket being closer to said load bearing surfaces than the opening in said base is.

5. Apparatus according to claim 3, wherein each of said socket and said base has a first load bearing surface engaging the first load bearing surface of the other and a second load bearing surface engaging the second load bearing surface of the other, and wherein the opening in said socket and the opening in said base each define a circle, the first load bearing surface on said socket faces generally toward said openings and the first load bearing surface on said base faces generally away from said openings, the second load bearing surface on said socket faces generally away from said openings, and the second load bearing surface on said base faces generally toward said openings, the circumference of the opening in said socket being closer to said first and load bearing surfaces than the opening in said base is.

6. Apparatus according to claim 1, wherein each of said socket and said base has a first load bearing surface engaging the first load bearing surface of the other and a second load bearing surface engaging the second load bearing surface of the other, each first load bearing defining an obtuse angle with the associated second load bearing surface.

7. Apparatus for removably mounting a cutter on a support for movement in a predetermined direction to cut a work surface, comprising:

a socket for receiving the cutter;

a base for receiving the socket;

means for securing the base to the movable support; and means for limiting the load, from forces due to cutting the work surface, imposed on said socket, said base, and said base securing means, to a level below a level which would damage either of said base and said securing means, wherein said load limiting means comprises a shear pin;

the forces due to cutting are imposed on said socket in a predetermined direction;

said socket has an opening defining a central axis perpendicular to said predetermined force direction;

said base has an opening defining a central axis perpendicular to said predetermined force direction, said openings being partially aligned to define a passageway; and said pin extends through said passageway.

8. Apparatus according to claim 7 wherein the shear pin comprises a radially expandable spring pin.

9. Apparatus according to claim 8, wherein the pin is a roll-shaped pin.

10. Apparatus according to claim 8, wherein the pin is a roll-shaped pin.

11. Apparatus according to claim 7, wherein the forces due to cutting have a component along a direction opposite to said predetermined direction of movement of the cutter, and said pin comprises the sole means for preventing movement of said socket in the direction of said force component.

* * * * *